US009605527B2

(12) United States Patent
Reiderman et al.

(10) Patent No.: US 9,605,527 B2
(45) Date of Patent: Mar. 28, 2017

(54) REDUCING ROTATIONAL VIBRATION IN ROTATIONAL MEASUREMENTS

(71) Applicant: Baker Hughes Incorporated, Houston, TX (US)

(72) Inventors: Arcady Reiderman, Houston, TX (US); Robert Estes, Tomball, TX (US); Fei Le, Houston, TX (US); Hanno Reckmann, Nienhagen (DE); Christian Herbig, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 333 days.

(21) Appl. No.: 13/706,212

(22) Filed: Dec. 5, 2012

(65) Prior Publication Data

US 2014/0151031 A1 Jun. 5, 2014

(51) Int. Cl.
*E21B 47/00* (2012.01)

(52) U.S. Cl.
CPC ..... *E21B 47/00* (2013.01)

(58) Field of Classification Search
CPC ..... E21B 49/003
USPC ..... 166/117.7, 104, 381, 255.2, 250.01
See application file for complete search history.

(56) References Cited

U.S. PATENT DOCUMENTS

| | | | | |
|---|---|---|---|---|
| 3,378,097 | A | 4/1968 | Straus et al. | |
| 4,876,672 | A | 10/1989 | Petermann et al. | |
| 5,450,914 | A * | 9/1995 | Coram | 175/73 |
| 6,173,793 | B1 * | 1/2001 | Thompson et al. | 175/45 |
| 6,247,542 | B1 * | 6/2001 | Kruspe et al. | 175/40 |
| 7,748,474 | B2 | 7/2010 | Watkins et al. | |
| 7,841,403 | B2 | 11/2010 | Minto et al. | |
| 8,225,868 | B2 | 7/2012 | Morley et al. | |
| 8,269,162 | B2 | 9/2012 | Kirkwood et al. | |
| 2004/0222019 | A1 * | 11/2004 | Estes et al. | 175/45 |
| 2008/0018334 | A1 | 1/2008 | Reiderman | |
| 2008/0294344 | A1 | 11/2008 | Sugiura | |

(Continued)

FOREIGN PATENT DOCUMENTS

WO 0107937 A1 2/2001

OTHER PUBLICATIONS

ISR in PCT/US2013/073109 dtd Mar. 14, 2014.

(Continued)

*Primary Examiner* — David Andrews
*Assistant Examiner* — Ronald Runyan
(74) *Attorney, Agent, or Firm* — Mossman Kumar & Tyler PC

(57) ABSTRACT

An apparatus for mitigation of torsional noise effects on borehole measurements. The apparatus may include a conveyance device; a sleeve having a sensor section, the sleeve rotatably disposed on the conveyance device; a sensor having at least one component disposed on the sensor section; and a driver coupled to the conveyance device and configured to rotate at least the sleeve sensor section. The driver may rotate the sleeve sensor section independent of the conveyance device. The driver may rotate the sleeve sensor section at a preset substantially constant rotational speed. The sleeve may include at least one arm configured to selectively lock the sleeve to a surface in the borehole. The driver may rotate the sleeve sensor section during measurement by the sensor. The driver may selectively couple the sleeve.

15 Claims, 4 Drawing Sheets

(56) References Cited

U.S. PATENT DOCUMENTS

| | | | | |
|---|---|---|---|---|
| 2009/0044953 | A1* | 2/2009 | Sheth et al. | 166/369 |
| 2009/0050370 | A1* | 2/2009 | Peters | E21B 7/06 175/45 |
| 2011/0012602 | A1 | 1/2011 | Reiderman et al. | |
| 2011/0036631 | A1* | 2/2011 | Prill | E21B 7/06 175/57 |
| 2011/0182535 | A1 | 7/2011 | Prieto | |
| 2011/0186284 | A1 | 8/2011 | Jekielek | |
| 2011/0298461 | A1* | 12/2011 | Bittar | G01V 3/28 324/338 |
| 2013/0092441 | A1 | 4/2013 | Hummes et al. | |
| 2013/0153243 | A1 | 6/2013 | King | |

OTHER PUBLICATIONS

IPRP in PCT/US2013/073109dtd Jun. 18, 2015, with Written Opinion dtd Mar. 14, 2014.
Examination Report in GB1511630.4 dtd Aug. 18, 2015.

* cited by examiner

REDUCING ROTATIONAL VIBRATION IN ROTATIONAL MEASUREMENTS

FIELD OF THE DISCLOSURE

In one aspect, this disclosure relates generally to methods for performing measurements in a wellbore with a rotating sensor. More particularly, this disclosure relates to methods, devices, and systems for mitigating effects of torsional noise on measurements from a rotating sensor.

BACKGROUND OF THE DISCLOSURE

Oil well logging has been known for many years and provides an oil and gas well driller with information about the particular earth formation being drilled. In conventional oil well logging, during well drilling and/or after a well has been drilled, a sensor may be conveyed into a borehole and used to determine one or more parameters of interest of the formation. A rigid or non-rigid conveyance device is often used to transport the sensor, often as part of a tool or set of tools, and the conveyance device may also provide communication channels for sending information up to the surface.

SUMMARY OF THE DISCLOSURE

In aspects, the present disclosure is related to methods of estimating a parameter of interest of a formation using information detected from a rotating sensor in a subterranean formation.

One embodiment according to the present disclosure may be an apparatus for mitigation of torsional noise effects on borehole measurements. The apparatus may include a conveyance device; a sleeve having a sensor section, the sleeve rotatably disposed on the conveyance device; a sensor having at least one component disposed on the sensor section; and a driver coupled to the conveyance device and configured to rotate at least the sleeve sensor section.

In general embodiments, the driver may be implemented as at least one of: i) a mud motor; ii) an electric motor; and iii) a hydraulic motor. The driver may rotate the sleeve sensor section independent of the conveyance device. The driver may rotate the sleeve sensor section at a preset substantially constant rotational speed. The sleeve may include at least one arm configured to selectively lock the sleeve to a surface in the borehole. The driver may rotate the sleeve sensor section during measurement by the sensor.

In other general embodiments, the driver may be implemented as a coupler that selectively couples the sleeve with a rotary power source. The rotary power source may be at least one of: i) the conveyance device; ii) a mud motor; iii) an electric motor; and iv) a hydraulic motor. The coupler couples the sleeve with the rotary power source to generate a target speed for the sleeve, and decouples the sleeve from the rotary power source.

In some embodiments, the apparatus includes a second sensor providing a response relating to a parameter of a fluid in viscous contact with the sleeve; and a processor configured to account for decay of rotational speed of the sleeve using an estimated viscosity of the fluid. The sleeve may include an actively stabilized non-rotating section disposed on the conveyance device. The at least one sensor component may include a magnet-coil assembly, which may have multiple receiving coils at different radii with respect to the axis of rotation of the sleeve. At least a magnet and at least one of the multiple receiving coils of the magnet-coil assembly may be mounted on the sleeve.

Another embodiment according to the present disclosure may be a method for mitigating torsional noise effects on borehole measurements, the method comprising disposing a sleeve having a sensor section on a conveyance device with at least one component of a sensor disposed on the sensor section; and rotating at least the sleeve sensor section independently of the conveyance device during measurement by the sensor.

Another embodiment according to the present disclosure may be a method for estimating a parameter of an earth formation, comprising: estimating the parameter using information from a rotating sensor incorporated into an apparatus of the present disclosure.

Another embodiment according to the present disclosure may be an apparatus for estimating a parameter of an earth formation, comprising: a processor; a subsystem non-transitory computer-readable medium; and a program stored by the non-transitory computer-readable medium comprising instructions that, when executed, cause the processor to estimate the parameter using information obtained from a rotating sensor incorporated in the apparatus of the present invention.

Examples of features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1A:
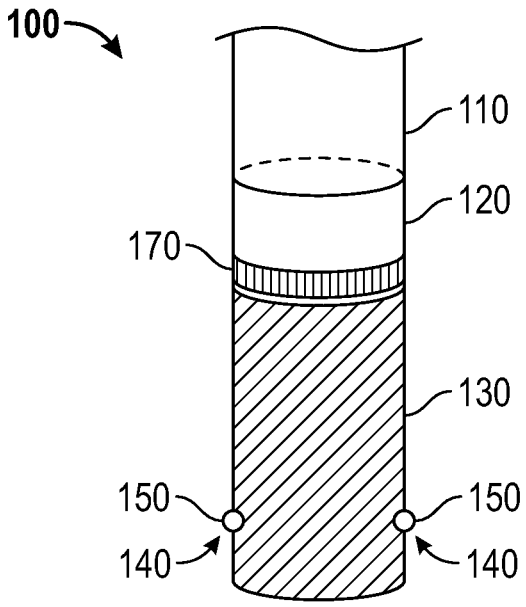
FIGS. 1A and 1B illustrate devices in accordance with embodiments of the present disclosure for mitigation of torsional noise effects on borehole measurements.

In aspects, this disclosure relates to mitigation of torsional noise effects on borehole measurements. A rotating borehole sensor may be sensitive to instability in rotational speed during measurement, causing inaccuracies during measurement. In many applications, this sensitivity is exacerbated by the sensor being coupled to a conveyance device experiencing unpredictable variations in rotational speed, or torsional noise, such as, for example, a rotating member of a bottom hole assembly ('BHA').

General embodiments of the present disclosure include methods, devices, and systems to generate angular speed for the sensor while mitigating effects of rotational vibration. Rotational vibration may be characterized as chaotic variations in angular speed that cause uncertainty in the angular speed. Mitigation may be achieved by mechanically decoupling the rotation of the sensor from the variable rotation of the conveyance device.

For some BHA applications, measurements may be taken during drilling operations, although in others drilling may be stopped. There may be a different measurement mode associated with each of measurement while drilling ("while-drilling") and measurement while drilling is stopped ("stop-drilling"). The "stop-drilling" mode may provide more accurate measurement, but may slow down drilling operations. The "while-drilling" mode may perform wellbore proximity measurement continuously while-drilling, but may provide measurement having lower accuracy. The devices and systems of the present disclosure may also be used in wireline or other non-drilling applications.

The sensor may be a downhole acoustic sensor used for 3-D imaging of the formation surrounding the wellbore. In another example, the sensor may be an electromagnetic sensor used to determine direction and/or distance to another borehole (e.g, a pre-existing well). Such a sensor may comprise an assembly including a magnet and a coil (magnet-coil assembly), wherein the magnet is used to create a time varying magnetic field in the other borehole, providing magnetization in a magnetic object in the other borehole; and a signal responsive to a magnetic flux resulting from the magnetization is measured using the coil. Methods using the magnet-coil assembly may estimate direction and/or distance to the pre-existing well and then use the estimated direction/distance to maintain a trajectory of the borehole in a desired relation (parallel, intersecting, etc.) to the other borehole.

In further examples, the sensor may provide information relating to a geological parameter, a geophysical parameter, a petrophysical parameter, and/or a lithological parameter. Example sensors may include formation evaluation sensors such as resistivity sensors, nuclear magnetic resonance (NMR) sensors, gamma ray detectors, and other sensors. Thus, sensors may include sensors for estimating formation resistivity, dielectric constant, the presence or absence of hydrocarbons, acoustic porosity, bed boundary, formation density, nuclear porosity and certain rock characteristics, permeability, capillary pressure, and relative permeability. It should be understood that this list is illustrative and not exhaustive.

FIG. 1A illustrates a device in accordance with embodiments of the present disclosure for mitigation of torsional noise effects on borehole measurements. The device 100 includes a conveyance device 110 and a sleeve 120 rotatably disposed on the conveyance device. The sleeve 120 is serially aligned with the conveyance device 110 in end-to-end fashion. The sleeve 120 may be supported on the conveyance device 110 by low friction bearings, or by other means known in the art. The sleeve 120 may be coaxial with the conveyance device 110. The device further includes a sensor 140 having one or more components. The sleeve 120 has a sensor section 130, and at least one component 150 of the sensor 140 is disposed on the sensor section 130. Sleeve sensor section 130 is rotatably mounted on the sleeve 120. The sensor section 130 and the remaining portion of the sleeve 120 may be axially adjacent to one another. Sensor component 150 is a measure electrode of a resistivity sensor (e.g., a resistivity array). In other embodiments, sensor section 130 may house other sensors having other components.

The device also includes a driver 170 coupled to the conveyance device 110 and configured to rotate at least the sleeve sensor section 130. Driver 170 may rotate the sleeve sensor section 130 during measurement by the sensor 140. Driver 170 comprises an independent motor. The motor employed may be one or more of a mud motor, an electric motor, and a hydraulic motor. Other embodiments using concentric configurations (see FIG. 1B) may also employ independent motors. Driver 170 rotates only the sensor section 130. In some implementations, the sleeve 120 may be stabilized to inhibit rotation, as described in detail below with reference to FIG. 3.

Figure 1B:
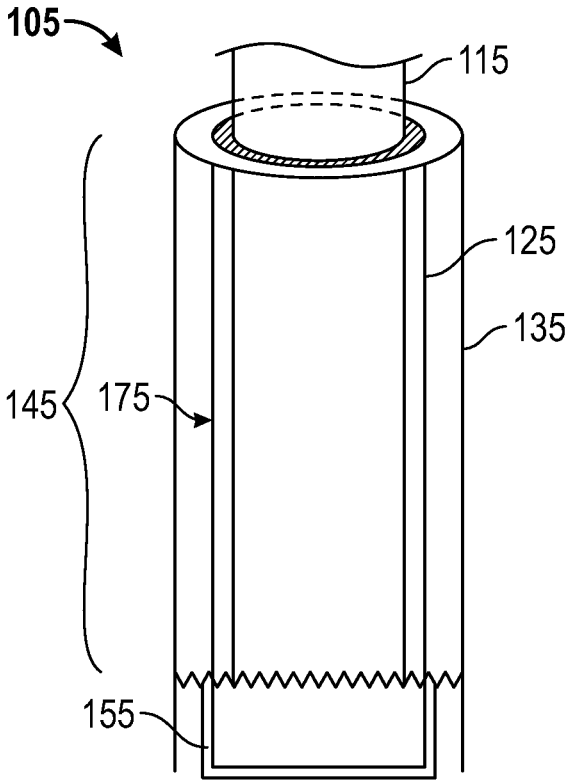

Alternatively, the sleeve may be concentrically mounted on the conveyance device or on a separate rotary power source, as illustrated in FIG. 1B. FIG. 1B illustrates another device in accordance with embodiments of the present disclosure for mitigation of torsional noise effects on borehole measurements. The device of the respective embodiments 105 includes a conveyance device 115 and a sleeve 125 rotatably disposed on the conveyance device. The sleeve 125 may be supported on the conveyance device 115 by low friction bearings, or by other means known in the art. The sleeve 125 may be coaxial with the conveyance device 115. The device further includes a sensor 145 having one or more components. The sleeve 125 has a sensor section 135, and at least one component 155 of the sensor 145 is disposed on the sensor section 135. The sensor section 135 may be disposed concentrically with respect to the remaining portion of the sleeve 125. The device also includes a driver 175 coupled to the conveyance device 115 and configured to rotate at least the sleeve sensor section 135. Driver 175 may rotate the sleeve sensor section 135 during measurement by the sensor 145.

Driver 175 comprises a coupler that selectively couples the sleeve with a rotary power source. The coupler (e.g. driver 175) rotates the entire sleeve 125. The coupler (e.g. driver 175) may be implemented as a cylindrical clutch. Embodiments using end-to-end configurations (see FIG. 1A) may also use a coupler, which may be implemented as a cylindrical clutch or other clutch type. The rotary power source is depicted as the conveyance device 115, but could also be implemented as one or more of the motors listed above. The component 155 may be a coil or a magnet of a magnet-coil assembly, as described in further detail with respect to FIG. 2.

In some embodiments, additional protective members (skins, sleeves, or sheets) may enclose the sleeve, sensor section, sensor components, or a combination of these. For example, the sensor components and all or a portion of the sleeve sensor section may be isolated from external drilling mud and cuttings by a thin sheet of protective metal skin. The spacing between the protective metal skin and the sensor components inside may be filled with a fluid (e.g., low-viscosity hydraulic fluid, well fluids, etc.) for pressure balancing in an open or closed system.

For coupler embodiments (see FIG. 1B) having components of the device (such as, for example, a sensor component, sensor sleeve section, etc.) in viscous contact with a fluid during free rotation, rotational speed of the sensor sleeve section may be dependent on viscosity of the fluid. Some implementations therefore include at least one sensor for determining an environmental parameter relating to viscosity of the fluid, such as, for example, temperature, pressure, and so on, as will occur to those of skill in the art. An information processing device may use sensor responses (e.g., alone, in combination with each other, in combination with reference data, and so on) to account for the effects of real-time fluid viscosity.

Although FIG. 1A illustrates elements of the disclosure in co-axial serial alignment and FIG. 1B illustrates elements of the disclosure combined concentrically, in many embodiments the device may be implemented with a combination of serially aligned and concentrically mounted components. Various other components (for example, sensors, couplers, rotary power source, and so on) illustrated herein with respect to various figures may be freely combined to form other embodiments that will be readily apparent from the present disclosure. For example, in variations of the present disclosure, a conveyance device may be end-to-end rotatably coupled to a sleeve having a concentrically mounted sleeve sensor section. The sleeve sensor section may circumscribe or be circumscribed by the sleeve.

Figure 2A:
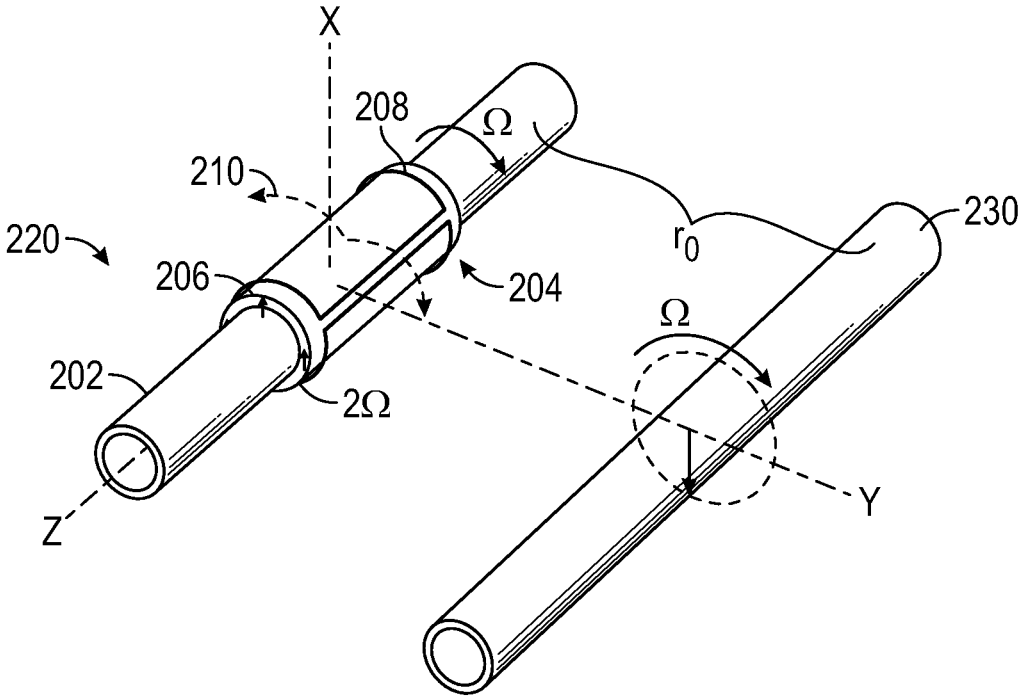
FIGS. 2A-2C show sensors of a device according to embodiments of the present disclosure.
Figure 2B:
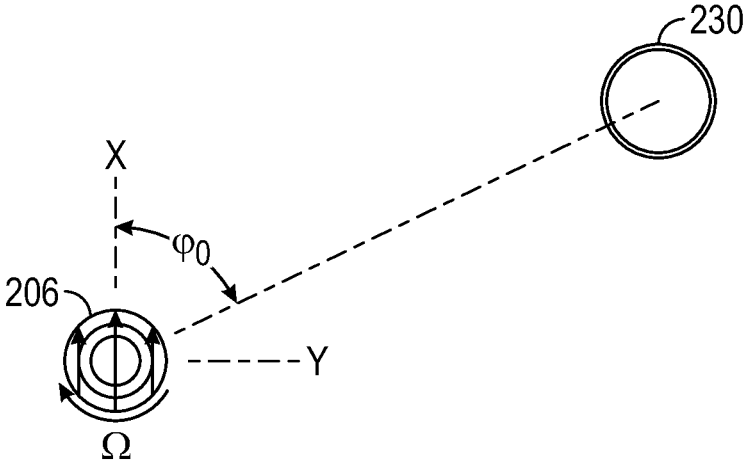
Figure 2C:
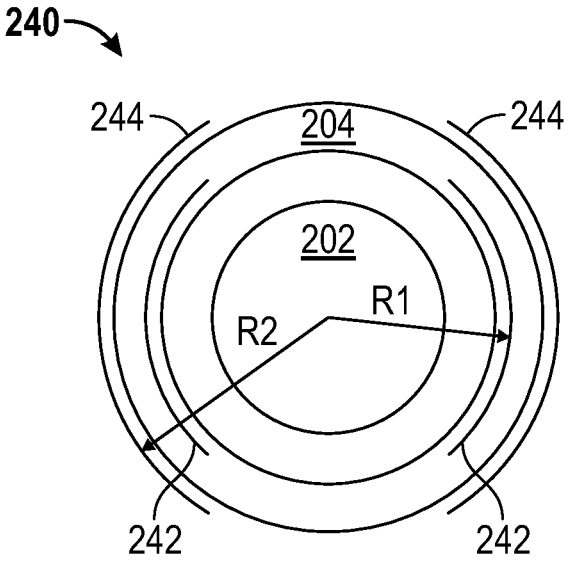

FIGS. 2A-2C show sensors of a device according to embodiments of the present disclosure. Turning now to FIG. 2A, a sensor 220 includes a permanent magnet 206 component shown on a sensor section 204 of a sleeve 202 connected to a driver (not shown) as described above. The driver may be connected to a conveyance device, such as the drill collar of FIG. 2. The magnet is transversely magnetized with the flux direction indicated by 210. A pre-existing well casing is denoted by 230. The coordinate axes x, y, and z are as indicated in the figure. The sensor 220 also includes a coil component 208 provided on the sleeve 202. The coil 208 rotates synchronously with the magnet 206, but the magnet-coil combination rotates independently of the drill collar during at least a portion of measurement by the sensor. In some instances, the magnet-coil combination may rotate independently of the conveyance device. The rotating magnet generates a time-varying magnetic field at a magnetic object such as the casing 230 of the pre-existing well. This variable magnetic field induces magnetization in the casing that, in turn, generates a variable magnetic flux picked up by the rotating coil 208, and produces a signal responsive to the magnetic flux which may be used to estimate the distance of the sensor 220 from the well casing 230 and/or the orientation of the well casing 230 with respect to the sensor 220.

FIG. 2B illustrates azimuthal dependence of a response voltage on the rotating coil 208. Using reference voltage $$V_{REF} \alpha \cos(2\omega t),$$

synchronized with the magnet/coil rotation, the following expression for the voltage on the coil 208 can be written $$V_{REF} = Vm \cdot \cos\,[2(\omega t + \phi_0)],$$

Here $\phi_0$ is the azimuth of the casing with respect to the pre-existing well casing. Thus the phase of the signal on the coil 208 is sensitive to the azimuthal position of the casing 205 with respect to the pre-existing well casing 230.

According to prior art, the approximate result of the receiver voltage takes the following form:

$$V_{COIL}(t) = \frac{45\mu_0 \cdot \omega \cdot \chi_{eff} \cdot p_m \cdot A_{CASING} \cdot A_{COIL}}{2048\pi \cdot r^5} \cdot \cos(2\omega \cdot t)$$

Here $\mu_0$ is the vacuum permeability;
$\chi_{effz}$ is the effective magnetic susceptibility of the casing;
$A_{CASING}$ is the cross-sectional area of the casing;
$A_{COIL}$ is the area of the receiver coil;
$p_m$ is the magnetic moment of the rotating magnet;
$\omega$ is the angular frequency of the magnet/coil assembly; and
r is the distance between the rotating magnet/coil assembly and the casing.

The above expression indicates that in order to obtain signals in the coil, the magnet/coil assembly needs to maintain an angular frequency $\omega$ with respect to the center of the drill collar. Since the signal induced by the rotating magnetization of the casing has a frequency which is twice the rotation frequency of the magnet/coil assembly, in ideal conditions the measured proximity signal is separable from a parasitic signal induced in the rotating coil due to the earth's magnetic field, which has a frequency equal to the magnet/coil rotation frequency. However, if the rotational speed of the magnet/coil assembly is not substantially constant, the parasitic signal from the earth's magnetic field will have a spectral component at twice the rotation frequency of the magnet/coil assembly, which is the same frequency as the measured proximity signal. Such parasitic signal cannot be removed by a frequency-domain filter and will remain as a problematic source of noise in the final result.

The device as described above is capable of generating angular speed for the magnet/coil assembly for well-bore proximity measurement using a rotating magnet while reducing rotational vibration sufficiently to mitigate parasitic signals from the earth's magnetic field.

Referring to FIG. 2C, sensor 240 includes multiple coils 242, 244 in the magnet coil assembly 246. Each coil may be at a different radius with respect to axis of rotation of the sleeve. For example, the first coil 242 on the sensor section 204 of sleeve 202 is positioned at radius R1. The second coil 244 positioned on the sleeve 202 beyond the sensor section is at radius R2. The second coil 244 may be non-rotating or may rotate at a different angular velocity than the first coil 242. Additional coils may be located at different radii on the sensor section 204, on sleeve 202 outside the sensor section, or on additional sleeves (not shown).

Figure 3:
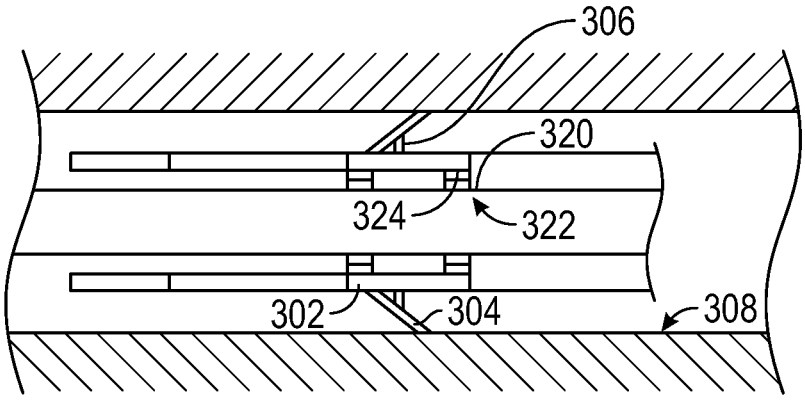
FIG. 3 shows an actively stabilized sleeve according to embodiments of the present disclosure.

Referring to FIG. 3, the sleeve 302 includes at least one force application member 304 configured to selectively lock the sleeve to a surface in the borehole to facilitate a stable rotational speed for the sleeve sensor section 130 (FIG. 1A). For instance, in one arrangement, an actuator 306 may be selectively energized to extend force application member 304 (e.g., rib, arm, or pad) and urge the member against the wall 308 of the wellbore. The actuator may be hydraulic, electric, and so on.

The non-rotating sleeve 302 provides a stationary base from which a precise speed of rotation may be achieved for the sensor section. The non-rotating sleeve 302 is a generally tubular element that is telescopically disposed around a bearing assembly housing 320. The sleeve 302 engages the housing 320 at bearings 322. The bearings 322 may include a radial bearing 324 that facilitates the rotational sliding action between the sleeve 302 and the housing 320 and a thrust bearing 324 that absorbs the axial loadings caused by the thrust of the drill bit against the borehole wall. Preferably, bearings 322 include mud-lubricated journal bearings 324 disposed outwardly on the sleeve 302.

Figure 4:
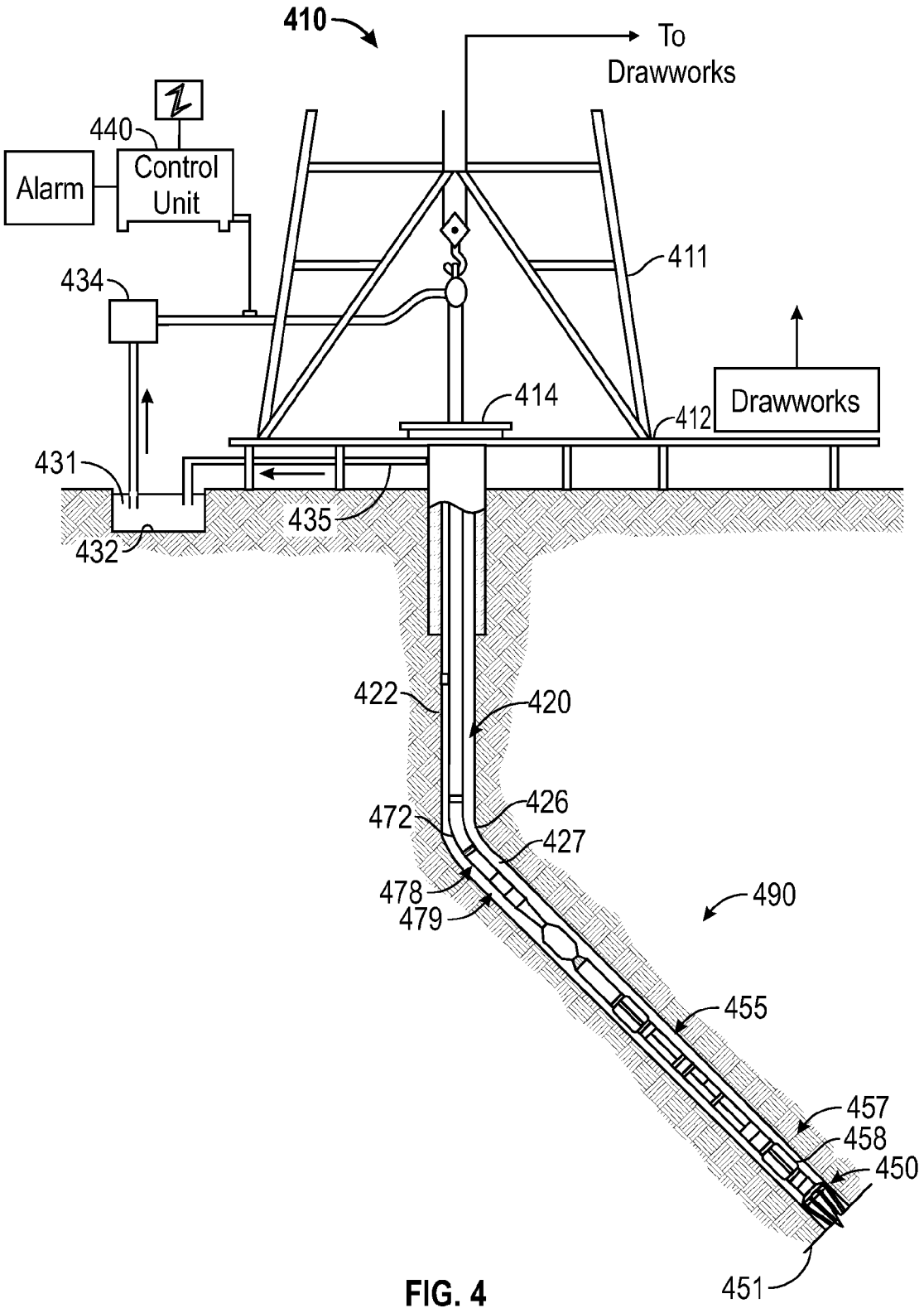
FIG. 4 shows a schematic diagram of a drilling system in accordance with embodiments of the disclosure.

Each of the above embodiments may be used in a variety of settings in both drilling and non-drilling environments. In some implementations, the above embodiments may be used as part of a drilling system. FIG. 4 shows a schematic diagram of an example drilling system in accordance with embodiments of the disclosure. Drilling system 410 includes a drill string 420 carrying a drilling assembly 490 (also referred to as the bottom hole assembly, or BHA) conveyed in a wellbore (borehole) 426 for drilling the wellbore. The BHA 490 may include a device for mitigation of torsional noise effects including a rotating sensor as described above. The device may alternatively or additionally be located elsewhere on the drilling system. The drilling system 410 further includes a conventional derrick 411 erected on a floor 412, which supports a rotary table 414 that is rotated by a prime mover such as an electric motor (not shown) at a desired rotational speed. The drill string 420 includes a tubing such as a drill pipe 422 or a coiled-tubing extending downward from the surface into the borehole 426. The drill string 420 is pushed into the well bore 426 when a drill pipe 422 is used as the tubing. For coiled-tubing applications, a tubing injector (not shown), is used to move the tubing from a source thereof, such as a reel (not shown), to the wellbore 426. The drill bit 450 attached to the end of the drill string breaks up the geological formations when it is rotated to drill the borehole 426.

During drilling operations, a suitable drilling fluid 431 from a mud pit (source) 432 may be circulated under pressure through a channel in the drill string 442 by a mud pump 434. The drilling fluid passes from the mud pump 434 into the drill string 420. The drilling fluid 31 may be discharged at the borehole bottom 451 through an opening in the drill bit 450. The drilling fluid 431 may circulate uphole through the annular space 427 between the drill string 420 and the borehole 426 and return to the mud pit 432 via a return line 435. The drilling fluid acts to lubricate the drill bit 450 and to carry borehole cutting or chips away from the drill bit 450.

In one embodiment of the disclosure, the drill bit 450 is rotated by only rotating the drill pipe 422. In another embodiment of the disclosure, a downhole motor 455 (mud motor) is disposed in the drilling assembly 490 to rotate the drill bit 450 and the drill pipe 422 is rotated usually to supplement the rotational power, if required, and to effect changes in the drilling direction.

In the embodiment of FIG. 4, the mud motor 455 may be coupled to the drill bit 450 via a drive shaft (not shown) disposed in a bearing assembly 457. The mud motor may rotate the drill bit 450 when the drilling fluid 431 passes through the mud motor 455 under pressure. The bearing assembly 457 supports the radial and axial forces of the drill bit. A stabilizer 458 coupled to the bearing assembly 457 may act as a centralizer for the lowermost portion of the mud motor assembly.

A suitable telemetry or communication sub 472 using, for example, two-way telemetry, may also be provided. The drilling sensor module processes the sensor information and transmits it to the surface control unit 440 via the telemetry system 472. The communication sub 472, a power unit 478 and an MWD tool 479 may all be connected in tandem with the drillstring 420. The communication sub 472 obtains the signals and measurements and transfers the signals, using two-way telemetry (i.e., uplink, downlink), for example, to be processed on the surface. Alternatively, the signals can be processed using a downhole processor in the drilling assembly 490.

The surface control unit or processor 440 may also receive signals from other downhole sensors and devices and signals from sensors used in the system 410 and process such signals according to programmed instructions provided to the surface control unit 440. The surface control unit 440 preferably includes a computer or a microprocessor-based processing system, memory for storing programs or models and data, a recorder for recording data, and other peripheral devices.

To identify and quantify parameters of interest, rotating sensors may be configured to acquire information relating to the downhole feature(s) of interest. The sensors may be in signal communication with a controller (not shown) via a suitable communication line. It should be understood that the type of sensors used on tool may depend in part on the downhole feature to be investigated.

Operation of the system may depend on the particular implementation of the device. Particular implementations may lend themselves to performing at least a portion of the measurement while rotation of the conveyance device is stopped ("stop-drilling" mode), while rotation of the conveyance device is occurring ("while-drilling" mode), or both.

Returning to FIG. 1A, rotation of the conveyance device 110 may be stopped during at least a portion of the measurement. Sleeve 120 may be held substantially geo-stationary. Driver 170 may rotate the sensor section 130 independent of the conveyance device 110. Rotation may be conducted during measurement by the sensor. Driver 170 may also rotate the sensor section 130 independent of the remainder of sleeve 120. Rotation of the sensor section may be maintained at a preset substantially constant rotational speed. The device may generate angular velocity in the sleeve sensor section at this time. The measurement can then be taken with sufficiently small rotational vibration.

Returning to FIG. 1B, in operation, the coupler (e.g. driver 175) couples the sleeve with the rotary power source (e.g. conveyance device 115, depicted as the drill string) to generate a target speed for the sleeve 125 (including sleeve section 135), and then decouples the sleeve 125 from the rotary power source during (or in anticipation of) measurement by the sensor. Measurements may be taken from the sensor while the sensor section is decoupled and in a rotational state independent from the rotation of the conveyance device (free rotation). The sleeve 125 may be repeatedly coupled and decoupled.

The rotational speed of the sensor may decay due to friction. An information processing device may account for the effect of the decay on measurements from the sensor 145 using historical or real-time parameters relating to environmental conditions correlated with the decay. For example, the information processing device may compensate for the broadening of the frequency spectrum caused by the decay to improve filtering of a parasitic signal as described above.

By geo-stationary it is meant that the sleeve does not move with respect to the surrounding wellbore/earth formation. By "substantially geo-stationary," it is meant rotation at a rate sufficiently low to allow use of the sensor to determine a parameter of interest of the borehole, examples of such a rate including, for example, fewer than 1 turn per minute, 20 turns an hour, 10 turns an hour, 1 turn an hour, and so on, down to and including zero rotation.

The term "conveyance device" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, self-propelled tractors. The term "information" as used above includes any form of information (analog, digital, EM, printed, etc.). The term "information processing device" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions.

Substantially constant rotational speed may be defined as an instantaneous rotational speed at a standard deviation within 2 percent, 1 percent, 0.5 percent, 0.2 percent, 0.1 percent, or less of its average value; a rotational speed enabling measurement of the instantaneous rotational speed at an accuracy with a relative error less than 2 percent, 1 percent, 0.5 percent, 0.2 percent, 0.1 percent, or less; a rotational speed sufficiently constant to result in a spectral component of a parasitic signal from the earth's magnetic field at less than 10, 5, 2, 1, 0.5, 0.2, or 0.1 percent of the sensor signal for an electromagnetic sensor; or a rotational speed with sufficient stability such that measurement error of the sensor due to torsional noise is less than 2, 1, 0.5, 0.2, or 0.1 percent.

While the present disclosure is discussed in the context of a hydrocarbon producing well, it should be understood that the present disclosure may be used in any borehole environment (e.g., a water or geothermal well).

The present disclosure is susceptible to embodiments of different forms. There are shown in the drawings, and herein are described in detail, specific embodiments of the present disclosure with the understanding that the present disclosure is to be considered an exemplification of the principles of the disclosure and is not intended to limit the disclosure to that illustrated and described herein. While the foregoing disclosure is directed to the one mode embodiments of the disclosure, various modifications will be apparent to those skilled in the art. It is intended that all variations be embraced by the foregoing disclosure.

We claim:

1. An apparatus for mitigation of torsional noise effects on borehole measurements, the apparatus comprising:

a bottom hole assembly (BHA);

a sleeve having a sensor section, the sleeve rotatably disposed on the BHA;

a sensor having at least one component disposed on the sensor section; and a driver coupled to the BHA and configured to rotate at least the sleeve sensor section such that the sleeve sensor section rotates about the BHA at a preset substantially constant rotational speed with respect to the borehole during measurement by the sensor, and wherein the driver comprises at least one of: (i) a motor that rotates the sleeve sensor section independent of the BHA and (ii) a coupler that selectively couples the sleeve with a rotary power source, wherein the driver is configured to maintain the instantaneous rotational speed of the sleeve sensor section at a standard deviation less than 2 percent of an average value of rotational speed.

2. The apparatus of claim 1, wherein the driver rotates the sleeve sensor section about the BHA at the preset substantially constant rotational speed during the measurement by the sensor.

3. The apparatus of claim 2, wherein the driver rotates the sleeve sensor section a plurality of revolutions at a preset substantially constant rotational speed during measurement by the sensor.

4. The apparatus of claim 1, wherein the driver includes at least one of: i) a mud motor; ii) an electric motor; and iii) a hydraulic motor.

5. The apparatus of claim 1, wherein the coupler couples the sleeve with the rotary power source to generate a target rotational speed for the sleeve with respect to the borehole, and decouples the sleeve from the rotary power source.

6. The apparatus of claim 5, further comprising a second sensor providing a response relating to a parameter of a fluid in viscous contact with the sleeve.

7. The apparatus of claim 6, further comprising a processor configured to account for decay of rotational speed of the sleeve using an estimated viscosity of the fluid.

8. The apparatus of claim 1, wherein the rotary power source is at least one of: i) the BHA; ii) a mud motor; iii) an electric motor; and iv) a hydraulic motor.

9. The apparatus of claim 1, wherein the at least one sensor component comprises a magnet-coil assembly.

10. The apparatus of claim 1, wherein the sensor comprises a magnet-coil assembly having multiple receiving coils at different radii with respect to the axis of rotation of the sleeve.

11. The apparatus of claim 10, wherein at least a magnet and at least one of the multiple receiving coils of the magnet-coil assembly are mounted on the sleeve.

12. The apparatus of claim 1, wherein the driver is configured to maintain the instantaneous rotational speed of the sleeve sensor section at a standard deviation less than 0.5 percent of an average value of rotational speed.

13. A method for mitigating torsional noise effects on borehole measurements, the method comprising:

disposing a sleeve having a sensor section on a bottom hole assembly (BHA) with at least one component of a sensor disposed on the sensor section; and using a driver coupled to the BHA to rotate at least the sleeve sensor section independently of the BHA about the BHA and with respect to the borehole at a preset substantially constant rotational speed during measurement by the sensor, wherein the driver comprises at least one of: (i) a motor that rotates the sleeve sensor section independent of the BHA and (ii) a coupler that selectively couples the sleeve with a rotary power source, wherein the driver is configured to maintain the instantaneous rotational speed of the sleeve sensor section at a standard deviation less than 2 percent of an average value of rotational speed.

14. An apparatus for mitigation of torsional noise effects on borehole measurements, the apparatus comprising:

a bottom hole assembly (BHA);

a sleeve having a sensor section, the sleeve rotatably disposed on the BHA;

a sensor having at least one component disposed on the sensor section; and a driver coupled to the BHA and configured to rotate at least the sleeve sensor section such that the sleeve sensor section rotates about the BHA at a preset substantially constant rotational speed with respect to the borehole during measurement by the sensor, and wherein the driver comprises at least one of: (i) a motor that rotates the sleeve sensor section independent of the BHA and (ii) a coupler that selectively couples the sleeve with a rotary power source;

wherein the sensor comprises a magnet-coil assembly having multiple receiving coils at different radii with respect to the axis of rotation of the sleeve.

15. An apparatus for mitigation of torsional noise effects on borehole measurements, the apparatus comprising:

a bottom hole assembly (BHA);

a sleeve having a sensor section, the sleeve rotatably disposed on the BHA;

a sensor having at least one component disposed on the sensor section;

a second sensor providing a response relating to a parameter of a fluid in viscous contact with the sleeve;

a driver coupled to the BHA and configured to rotate at least the sleeve sensor section such that the sleeve sensor section rotates about the BHA at a preset substantially constant rotational speed with respect to the borehole during measurement by the sensor, and wherein the driver comprises at least one of: (i) a motor that rotates the sleeve sensor section independent of the BHA and (ii) a coupler that selectively couples the sleeve with a rotary power source, wherein the coupler couples the sleeve with the rotary power source to generate a target rotational speed for the sleeve with respect to the borehole, and decouples the sleeve from the rotary power source; and a processor configured to account for decay of rotational speed of the sleeve when decoupled using an estimated viscosity of the fluid from the response of the second sensor.

* * * * *